United States Patent [19]

Cencula, Sr.

[11] Patent Number: 4,473,062

[45] Date of Patent: Sep. 25, 1984

[54] COMBUSTION AIR DIVERTER FOR FIREPLACE ASH PIT OPENING

[76] Inventor: Arthur A. Cencula, Sr., 20772 W. Verona Ave., Lake Villa, Ill. 60046

[21] Appl. No.: 512,104

[22] Filed: Jul. 7, 1983

[51] Int. Cl.[3] ..... F24B 13/02

[52] U.S. Cl. ..... 126/143; 126/242

[58] Field of Search ..... 126/143, 120, 121, 242, 126/163 R, 163 A, 164, 285 R, 288; 237/51; 98/103

[56] References Cited

U.S. PATENT DOCUMENTS

| | | | |
|---|---|---|---|
| 2,103,171 | 12/1937 | Nilson | 126/120 |
| 2,249,308 | 7/1941 | Bedol | 98/103 |
| 4,136,666 | 1/1979 | Haas | 126/143 |
| 4,213,445 | 7/1980 | Mayo | 126/143 |
| 4,248,205 | 2/1981 | Saunders | 126/120 |
| 4,374,515 | 2/1983 | Conrad | 126/143 |

*Primary Examiner*—James C. Yeung

*Attorney, Agent, or Firm*—Harvey B. Jacobson

[57] ABSTRACT

A pair of open-sided and inverted channel members of substantially the same cross-sectional shape are disposed in laterally nested relation with the exterior transverse cross-sectional area of the inner channel member being substantially the same as the interior cross-sectional area of the outer channel member. The channel members are freely longitudinally shiftable relative to each other between relatively lengthwise extended and retracted positions and adjustable damper structure is carried by opposite ends of the channel members for adjustably throttling the discharge of combustion air therefrom when the channel members are disposed upon and supported from the floor portion of a fireplace upwardly through which a combustion air inlet opens. An associated fireplace grate for supporting wood to be burned may be positioned over the air diverter and the length of the latter as well as the adjustable damper structure may be used to divert the desired quantities of combustion air toward opposite side portions of the solid fuel to be burned upon the fireplace grate.

8 Claims, 4 Drawing Figures

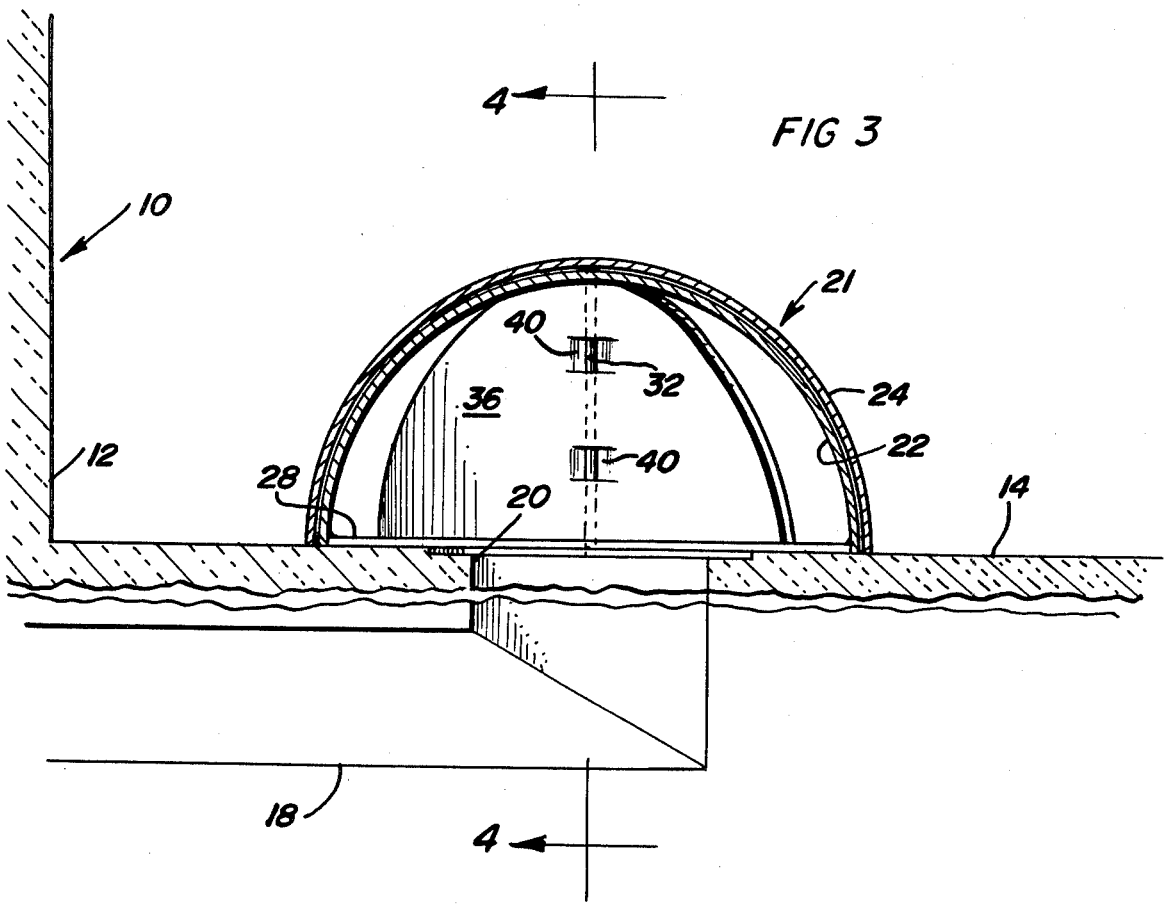
FIG 3
FIG. 4
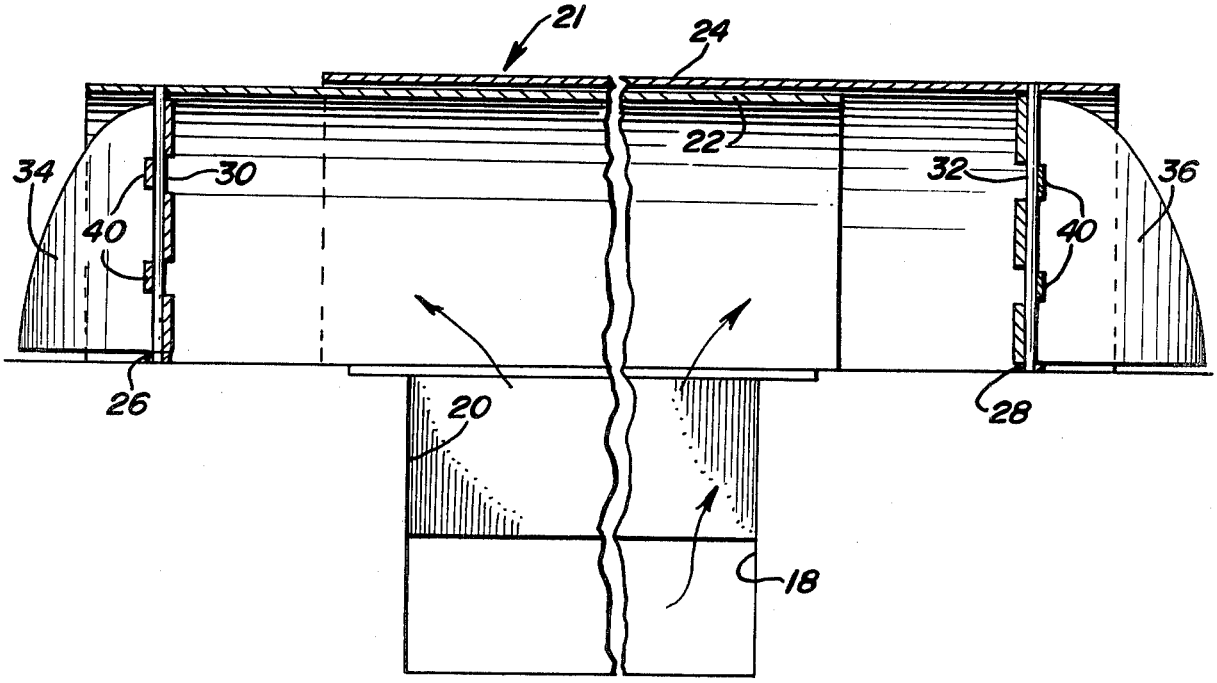

COMBUSTION AIR DIVERTER FOR FIREPLACE ASH PIT OPENING

BACKGROUND OF THE INVENTION

Numerous fireplaces include ash pit doors which open upwardly through the floor of a fireplace and many of these ash pits are now being converted to combustion air inlets in order that combustion air for the fireplace may be drawn from a cool basement portion of a residence as opposed to drawing combustion air through the open side of the fireplace. In this manner, the open side of the fireplace may be closed by transparent fireplace doors and a considerable reduction in the flow of outside air passing inwardly through voids in a residence construction in order to replace combustion air admitted into a fireplace is realized.

However, most fireplace ash pits open upwardly through the floor of the associated fireplace in a central portion therein and combustion air being discharged from an ash pit converted to a fresh air inlet causes combustion air to flow rapidly toward a relatively small area of the solid fuel supported from a fireplace grate disposed over the combustion air inlet with the result that the burning rate of solid fuel within the fireplace is excessive.

Accordingly, a need exists for structure by which an ash pit converted to a combustion air inlet for a fireplace may have an air diverter operatively associated therewith so that combustion air being discharged from the ash pit upwardly into the fireplace may be diverted and supplied to remote portions of an accumulation of solid fuel being burned in an associated fireplace grate.

Also, a need exists to provide means whereby the combustion air admitted into a fireplace through a converted ash pit may be throttled to the desired rate.

Various forms of air throttling and diverting structures for use in conjunction with ash pits and other similar air inlets and which include some of the general structural and operational features of the instant invention are disclosed in U.S. Pat. Nos. 4,106,475, 4,136,666, 4,184,474, 4,186,719 and 4,374,515.

BRIEF DESCRIPTION OF THE INVENTION

The combustion air diverter of the instant invention comprises a pair of slightly different size semi-cylindrical channel members which are disposed in laterally nested relation and may be positioned in inverted position upon the floor area of a fireplace upwardly through which an ash pit opens. The channel members may be longitudinally extended or retracted relative to each other and opposite ends of the channel members include adjustable damper structure whereby the combustion air discharged from the remote ends of the nested channel members may be variably throttled.

The main object of this invention is to provide a combustion air diverter for use in conjunction with a fireplace including a floor portion upwardly through which a combustion air inlet open.

Another object of this invention is to provide a combustion air inlet diverter for a floor fresh air inlet of a fireplace and which will be operative to divert combustion air toward remote portions of a quantity of solid fuel to be burned within the fireplace.

Still another important object of this invention is to provide a combustion air diverter for a fireplace including structure by which the amount of combustion air discharged therethrough may be adjustably throttled.

Another object of this invention is to provide a combustion air diverter which may be used in conjunction with substantially all fireplace floor fresh air inlet openings.

A final object of this invention to be specifically enumerated herein is to provide a combustion air diverter for a fireplace fresh air inlet opening through the floor of the fireplace and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a pair hereof, wherein like numerals refer to like parts throughout.

BRIEF DESCRIPTION OF THE DRAWINGS

FIG. 3 is a further enlarged vertical sectional view taken substantially upon the plane indicated by the section line 3—3 of FIG. 2; and FIG. 4 is a vertical sectional view taken substantially upon the plane indicated by the section line 4—4 of FIG. 3.

DETAILED DESCRIPTION OF THE INVENTION

Figure 1:
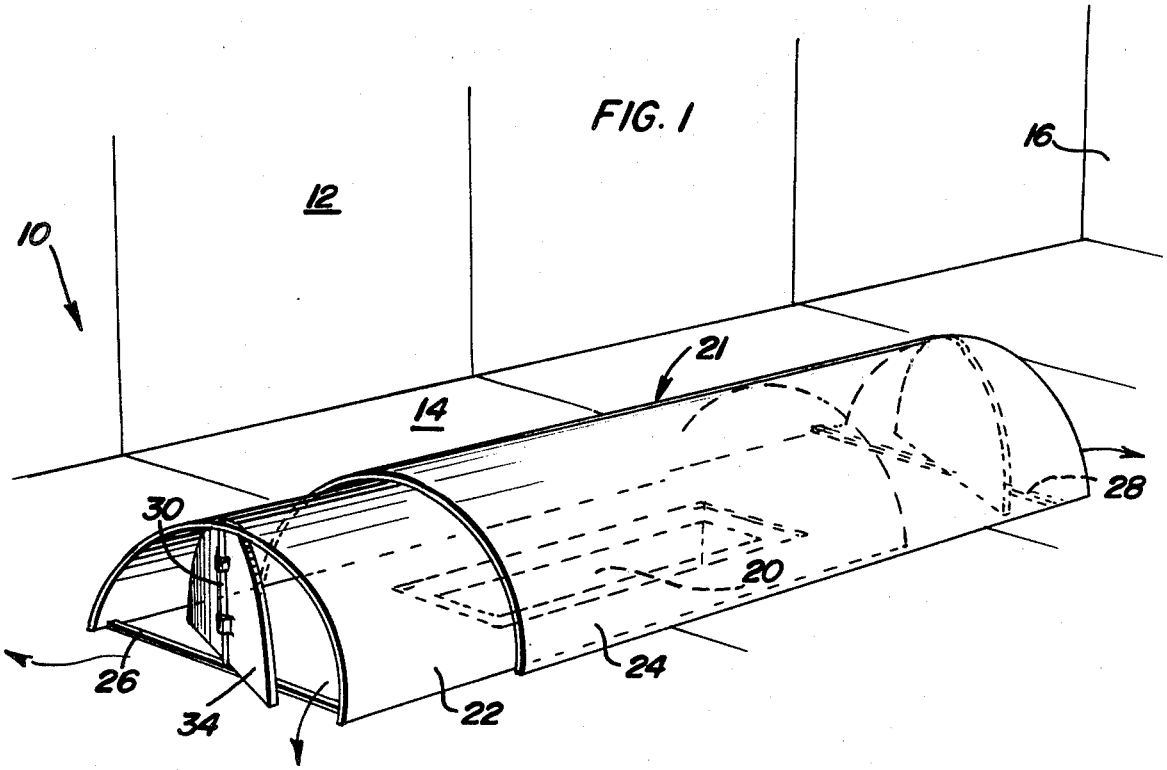
FIG. 1 is a fragmentary perspective view of the floor area of a conventional fireplace upwardly through which a combustion air inlet opens and with the combustion air diverter of the instant invention operatively associated with the combustion air inlet opening.

Referring now more specifically to the drawings the numeral 10 generally designates a conventional form of fireplace having a rear wall 12 and a floor 14 as well as opposite side walls 16. The side of the fireplace remote from the rear wall 12 is open, in the usual manner, and may be closed, if desired, by a glass fireplace front which is operative to prevent room air from entering the fireplace 10 in order to support combustion of a fire therein.

The fireplace 10 additionally includes a passage 18 opening upwardly through a central portion of the floor 14 thereof. The inlet end of the passage 18 may open outwardly to the exterior of the associated building whereby fresh outside air may be admitted to the interior of the fireplace 10 for supporting the combustion of solid fuel therein, or the passage 18 may comprise a substantially vertical passage extending downwardly to a lower floor such as a basement room and opening laterally inwardly into that room and used for receiving ashes from the fireplace 10. However, if such a vertical passage 18 is to be used for combustion air, it will be used primarily for that purpose and only occasionally as an ash disposal passage.

The outlet end of the passage 18 opens upwardly through the floor 14 and includes a generally rectangular cross section outlet end 20. The combustion air diverter of the instant invention is referred to in general by the reference numeral 21 and comprises a pair of inner and outer nested semi-cylindrical channel members 22 and 24. The channel members 22 and 24 may be disposed upon and supported from the floor 14 in the manner illustrated in FIGS. 1 and 3 of the drawings with the channel members 22 and 24 endwise extended relative to each other. It will be noted that the outside cross-sectional dimensions of the inner channel member 22 are slightly smaller than the inside cross-sectional dimensions of the outer channel member 24. In this manner, the channel members 22 and 24 may be closely nested relative to each other with the lower longitudinal edges thereof abutting and supported from the floor 14 both forward and rearward of the outlet end 24 of the passage 18.

The remote extended ends of the channel members 22 and 24 include transverse braces 26 and 28 extending and secured between the lower marginal edges thereof and a pair of pivot posts 30 and 32 extend between the midportions of the braces 26 and 28 and those portions of the corresponding ends of the channel members 22 and 24 disposed vertically thereabove.

The posts 30 and 32 pivotally support semi-circular damper plates 34 and 36 therefrom whereby the remote extended ends of the channel members 22 and 24 may be variably closed. The damper plates 34 and 36 may be swung a full 360° about the pivot posts 30 and 32 for a purpose to be hereinafter more fully set forth.

In operation, a log or coal supporting grate is usually positioned within the fireplace 10 and supported from the floor 14 thereof immediately above the outlet end 24 of the passage 18. The diverter 22 is disposed over the outlet end 24 of the passage 18 in the manner illustrated in FIG. 1 of the drawings beneath the aforementioned grate and the damper plates 34 and 36 may be adjusted by utilizing a poker or similar tool to angularly displace the damper plates 34 and 36 as desired. It will be noted that the posts 30 and 32 are stationary and that the damper plates 34 and 36 include laterally struck portions 40 defining hinge barrels for the pivot posts 30 and 32 and which are frictionally engaged with the posts 30 and 32 in order that the damper plates 34 and 36 will be frictionally retained in adjusted angularly displaced positions.

Figure 2:
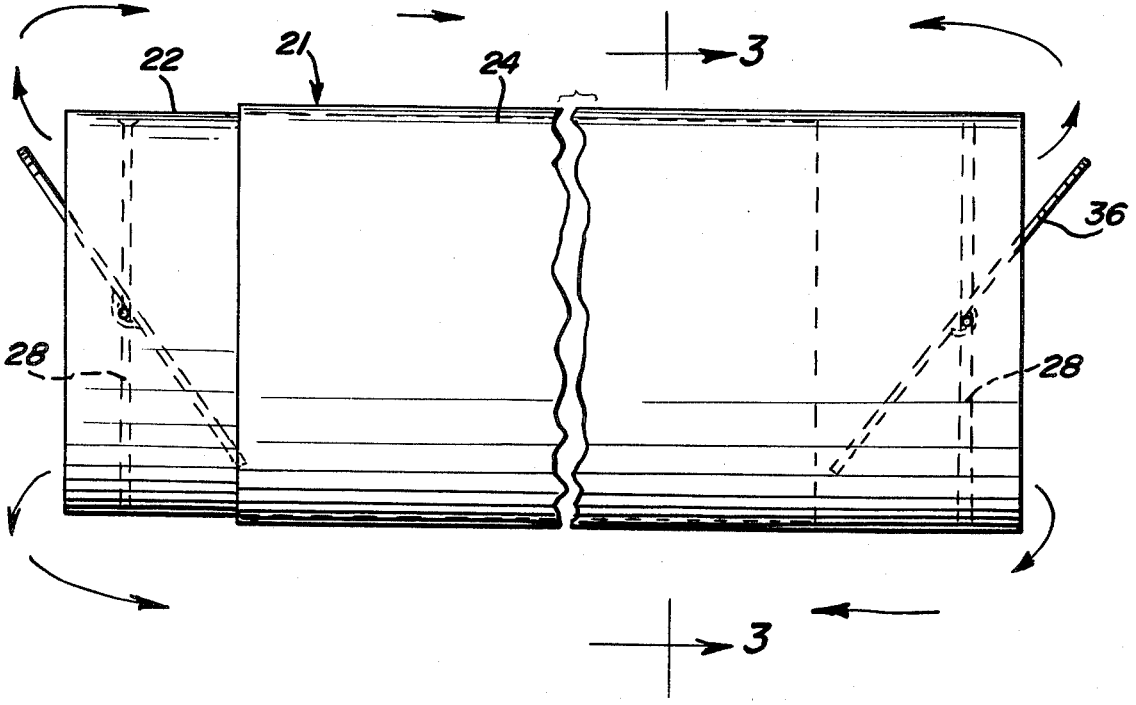
FIG. 2 is an enlarged top plan view of the combustion air diverter.

The damper plates 34 and 36 may be used to variably throttle the amount of combustion air being discharged from the opposite ends of the diverter 22 and if the damper plates 34 and 36 are inclined in the manner illustrated in FIG. 2 of the drawings, a major portion of the combustion air discharged from the diverter 22 will be directed toward opposite side rear portions of the fireplace 10. However, if the damper plates 34 and 36 are oppositely inclined relative to the positions thereof illustrated in FIG. 2, major portions of the combustion air discharged from the opposite ends of the diverter 22 will be directed toward opposite side portions of the forward area of the fireplace 10.

Any suitable heat resistant material may be used in the construction of the diverter 22. Further, the length of the diverter 22 may be adjusted as desired in order to vary the spacing between the opposite ends thereof and the areas from which combustion air is discharged into the fireplace 10.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A combustion air diverter for mounting over a combustion air inlet opening upwardly through the floor of a fireplace, said diverter including a pair of open-sided inverted and open-ended channel members of substantially the same cross-sectional shape disposed in laterally nested relation with the exterior transverse cross-sectional area of the inner channel member being substantially the same as the interior cross-sectional area of the outer channel member, said channel members being freely longitudinally shiftable relative to each other between relatively lengthwise extended and retracted positions, adjustable damper means disposed within the opposite ends of said channel members, support means supporting said damper means within said opposite ends for shifting relative thereto through a range of adjusted shifted positions adjustably throttling the discharge of combustion air from said opposite ends when said channel members are disposed upon and supported from the floor portion of a fireplace upwardly through which a combustion air inlet opens.

2. The combustion air diverter of claim 1 wherein said channel members are substantially semi-cylindrical in cross-sectional shape.

3. The combustion air diverter of claim 2 wherein said damper means comprise substantially semi-circular damper plates mounted within said opposite ends for angular displacement relative thereto about upstanding axes.

4. The combustion air diverter of claim 3 wherein said support means includes pivot means effecting at least minimal frictional resistance to angular displacement of said damper plates relative to said channel members.

5. The combustion air diverter of claim 1 wherein said damper means upstanding damper plates mounted in said remote ends of said channel members for angular displacement relative thereto about upstanding axes, said damper plates being of a shape and size corresponding to the cross-sectional shape and area of the corresponding ends of said channel members.

6. The combustion air diverter of claim 1 wherein said support means includes transverse braces secured across said opposite ends, upstanding pivot posts supported from and extending between the mid-portions of said braces and upper peak portions of said channel members disposed immediately there above, said damper means comprising damper plates pivotally mounted on said posts.

7. The combustion air diverter of claim 6 wherein said damper plates are pivotally supported from said posts for limited frictional resistance to angular displacement relative thereto.

8. A combustion air diverter for mounting over a combustion air inlet opening upwardly through the floor of a fireplace, said diverter including a pair of open-sided inverted and open-ended channel members of substantially the same cross-sectional shape disposed in laterally nested relation with the exterior transverse cross-sectional area of the inner channel member being substantially the same as the interior cross-sectional area of the outer channel member, each channel member including one end thereof lengthwise extended at least slightly relative to the corresponding end of the other channel member, adjustable damper means disposed within said extended ends of said channel members, support means supporting said damper means within said extended ends for shifting relative thereto through a range of adjusted shifted positions adjustably throttling the discharge of combustion air from said extended ends when said channel members are disposed upon and supported from the floor portion of a fireplace upwardly through which a combustion air inlet opens, said channel members being freely longitudinally shiftable relative to each other for varying the spacing between one ends and independent of shifting of said damper means relative to said one ends.

* * * * *